US006679710B2

(12) United States Patent
Saito et al.

(10) Patent No.: US 6,679,710 B2
(45) Date of Patent: Jan. 20, 2004

(54) ELECTRONIC UNIT DEVICE

(75) Inventors: Yoshiyuki Saito, Yamagata (JP); Mikio Takahashi, Yamagata (JP)

(73) Assignee: NEC Corporation, Tokyo (JP)

( * ) Notice: Subject to any disclaimer, the term of this patent is extended or adjusted under 35 U.S.C. 154(b) by 241 days.

(21) Appl. No.: 09/847,686

(22) Filed: May 2, 2001

(65) Prior Publication Data

US 2001/0029122 A1 Oct. 11, 2001

(30) Foreign Application Priority Data

Feb. 5, 2000 (JP) ..... 2000/133224

(51) Int. Cl.[7] ..... H01R 13/44
(52) U.S. Cl. ..... 439/142; 312/292
(58) Field of Search ..... 439/142, 144, 439/136, 135, 141, 138; 220/326, 352; 312/292

(56) References Cited

U.S. PATENT DOCUMENTS 4,655,057 A * 4/1987 Derman ..... 70/14
5,076,461 A * 12/1991 Nichols ..... 220/352
5,199,888 A * 4/1993 Condra et al. ..... 439/142
5,574,625 A * 11/1996 Ohgami et al. ..... 312/223.2
6,058,523 A * 5/2000 Sleboda ..... 4/619
6,241,328 B1 * 6/2001 Ziff ..... 312/1

* cited by examiner

*Primary Examiner*—Neil Abrams
*Assistant Examiner*—Phuong K T Dinh
(74) *Attorney, Agent, or Firm*—Scully, Scott, Murphy & Presser

(57) ABSTRACT

An electronic unit device includes a connector and a casing. The connector is connectable to a to-be-connected device. The casing includes a cover panel which can be opened and closed. The cover panel comprises a panel body and a partial panel. The panel body has a cut section. The partial panel is attachable and detachable to and from the cut section, and covers at least the surface of the connector, when the partial panel is attached into the cut section. The panel body includes a falling-prevention section, for preventing the installed partial panel from falling from the cut section, and a guide section for guiding the partial panel. The partial panel includes at least one engagement section to be engaged with the falling prevention section. The partial panel includes a section, to be in contact with the panel body, which is formed in such a shape as to be fit into the guide section.

17 Claims, 14 Drawing Sheets

ELECTRONIC UNIT DEVICE

BACKGROUND OF THE INVENTION

1. Field of the Invention

The present invention relates to an electronic unit device, and more particularly to an electronic unit device having a cover panel which covers a connector for connecting the electronic unit to a peripheral device.

2. Description of the Related Art

Generally, people use an electronic unit device, such as a portable personal computer, mobile personal computer, etc., in various usage styles in accordance with their purpose.

In the case where users of such en electronic unit device use a portable personal computer (hereinafter, referred to simply as a PC), for example, the PC is connected to a peripheral device for expanding the functions of the portable PC at office. In addition, when to carry the portable PC, the peripheral device is detached from the portable PC so as to be light in weight. In such circumstances, it is necessary that the peripheral device is attached and detached to and from the portable PC in accordance with the usage contexts of the portable PC. To perform the attaching and detaching of the peripheral device to and from the portable PC with high efficiency, according to a conventional wiring technique, the peripheral device is connected to a port bar (a port replicator), for example, and the port bar is connected to a connector of the portable PC. Having performed the above wiring, a plurality of peripheral devices can be attached and detached to and from the indirectly-connected portable PC, by attaching and detaching the port bar connected directly to the portable PC.

When the port bar is installed in the portable PC, the port bar is to cover the casing surface of the portable PC in which the port bar is installed. In consideration of this fact, a connector for replacing the port bar is prepared around a connector for the port bar. Such a connector includes one for connecting a printer, an external display, etc. to the portable PC. Thus prepared connector is not necessary when the port bar is installed in the portable PC. Hence, the connector can be arranged in a such position of the casing that the connector is covered by the port bar.

Though such structure is prepared, in most cases, the users do not frequently attach and detach the peripheral device to and from the portable PC, and the portable PC is connected only to a minimum-required peripheral device(s). Conventionally, a cover panel which covers the connector for the port bar, etc. is included in the body part of the portable PC. Further, the connector for the port bar is covered by a single cover panel, together with a neighboring connector(s).

The cover panel can be opened and closed, and closed when the connector is not in use, and has a function as a lid for protecting the connector from dust, etc. The users uses the connector in a manner as described below.

When the user connects the portable PC to the port bar, he/she opens the cover panel. After this, the user attaches the port bar to the connect, in the state where the cover panel is still opened.

Hence, when the user attaches the port bar to the connector, the port bar contacts the cover panel which is in an unstable state. At this time, the cover panel may be damaged or fall from the casing of the portable PC, due to the contact with the port bar.

In order to solve the above problem, when the user attach the port bar to the connector of the portable PC, he/she needs to firmly hold the cover panel by one hand. In this case, the user needs to attach the port bar by the other hand. Under such circumstances, when to connect the port bar to the portable PC, the portable PC needs to include means for holding the cover panel while being opened, so that the user can connect the port bar to the portable PC with ease.

Even if the casing of the portable PC includes the above-described means, dust may enter any connector(s) other than the connector for the port bar, and the cover panel does not have the essential function for protecting the connector(s).

SUMMARY OF THE INVENTION

The present invention has been made in consideration of the above. It is accordingly an object of the present invention to provide an electronic unit device to and from which a target device to be connected can be attached and detached with ease.

In order to achieve the above object, according to the first aspect of the present invention, there is provided an electronic unit device comprising:

- a connector which is connectable to a to-be-connected device; and
- a casing having a panel body, which includes a cut section, and a partial panel which is attachable and detachable to and from the cut section and covers at least the connector when the partial panel is attached to the cut section.

According to the above structure, a target device to be connected can be connected to the connector, in the state where the partial panel is taken out from the cover panel so as to close the cover panel.

In order to accomplish the above object, according to the second aspect of the present invention, there is provided an electronic unit device comprising:

- a casing which contains an electronic device;
- a connector which is included inside the casing and connectable to a to-be-connected device; and
- a cover panel which includes a panel body, which has a cut section, and a partial panel which is attachable and detachable to and from the cut section, fills the cut section with the partial panel when the partial panel is attached to the cut section, and covers at least a surface of the connector.

According to the above structure, a target device to be connected can be connected to the connector, in the state where the partial panel is taken out from the cover panel so as to close the cover panel.

The panel body may include one side facing the cut section and being connected to an outer wall of the casing, and can be opened and closed pivotably about the one side facing the cut section.

The partial panel may have a shape which corresponds to a shape of the cut section.

The panel body may include a falling-prevention section for preventing the partial panel from falling from the cut section.

According to the above structure, the partial panel is prevented from falling from the panel body, even in the state where the cover panel is closed.

The panel body may include a guide section which can guide the partial panel.

According to the above structure, the partial panel can be guided by the guide section of the panel body. Thus, the partial panel can easily be attached and detached to and from the cut section.

The partial panel may include at least one engagement section which can be engaged with the falling-prevention section.

The partial panel may include a section, which contacts the panel body and is so formed as to be engaged with the guide section.

The panel body may include the cut section which is formed in a rectangular shape; and the guide section may include a projection section or groove having substantially a same section throughout a longitudinal direction of each of facing sides of the cut section.

According to the this structure, the partial panel can be attached and detached to and from the cut section in a predetermined direction.

The partial panel may be formed substantially in a rectangular shape, and includes a projection section or groove having substantially a same section throughout a longitudinal direction thereof, along an edge corresponding to the guide section of the panel body.

The engagement section may be formed of an elastic material.

According to this structure, the panel body can be attached and detached to and from the partial panel.

BRIEF DESCRIPTION OF THE DRAWINGS

The object and other objects and advantages of the present invention will become more apparent upon reading of the following detailed description and the accompanying drawings in which.

DETAILED DESCRIPTION OF THE PREFERRED EMBODIMENT

A preferred embodiment of the present invention will now be explained with reference to the accompany drawings.

Figure 1:
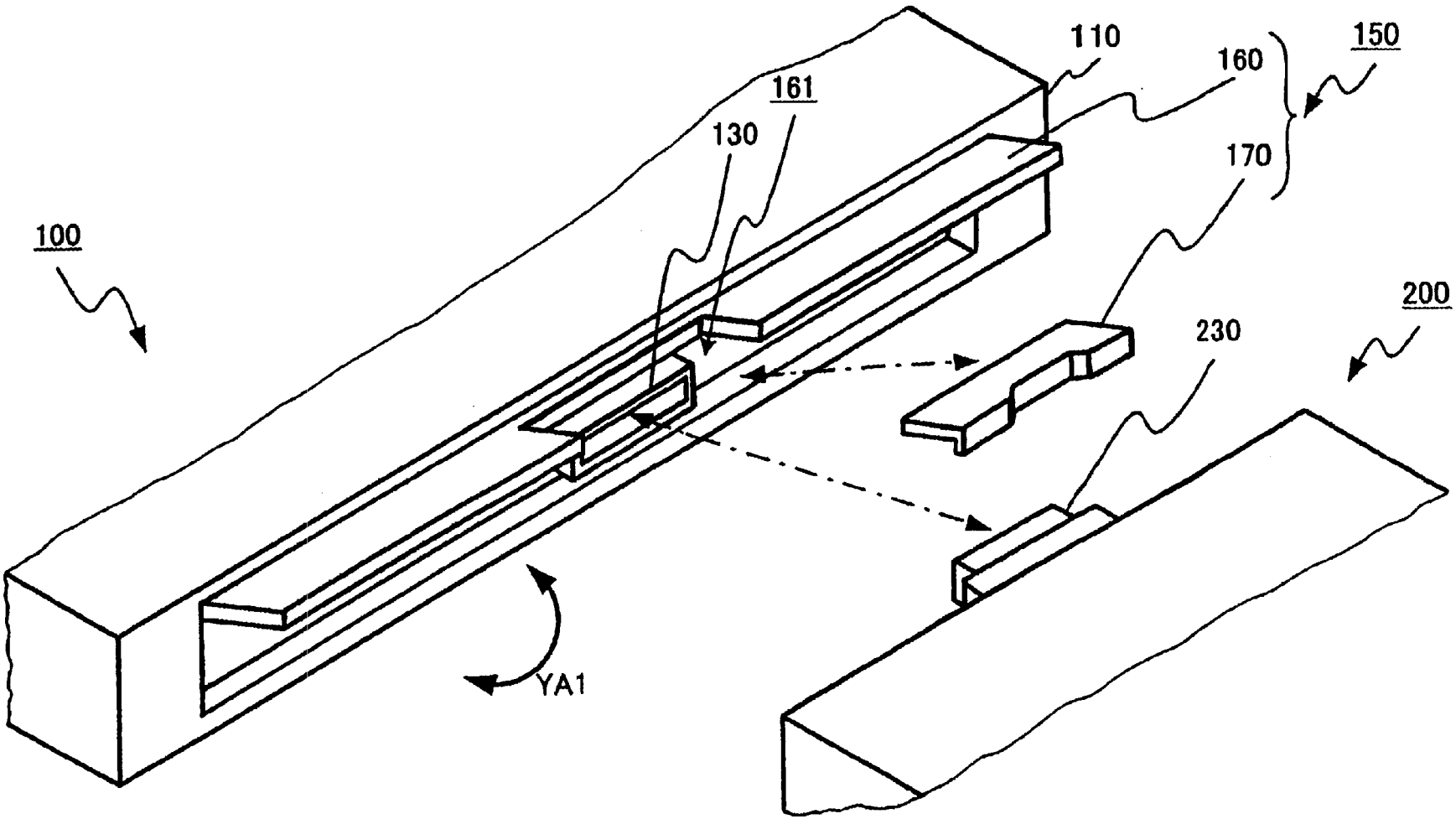
FIG. 1 is a perspective diagram for explaining the connection between an electronic unit device according to an embodiment of the present invention and peripheral units thereof.

FIG. 1 is a diagram showing the back surface of an electronic unit device and a peripheral device 200 which is connected to the electronic unit device 100.

The electronic unit device 100 is, for example, a portable type personal computer. A casing 110 contains a circuitry substrate such as a CPU (Central Processing Unit), memory, and the like. The electronic unit device 100 is connected to a peripheral device 200, thereby to have an expanded function.

The peripheral device 200 is a function expanding unit, such as a port bar (a port replicator), or the like, and includes a connector, such as a serial port, parallel port, external display output connector, etc.

As illustrated in FIG. 1, a connector jack 130, as a connector, is arranged in a central section of the back surface of the casing 110 included in the electronic unit device 100. The peripheral device 200 has a connector plug 230 which corresponds to the connector jack 130, so that the electronic unit device 100 is connected to the peripheral device 200.

A cover panel 150 for protecting the connector jack 130 is prepared in the casing 110. The cover panel 150 includes a panel body 160 and a small panel (a cap) 170 which is attachable to and detachable from the panel body 160. The cover panel 150 has such a structure that the connector jack 130 is pivotably open and closed about one side in a manner shown with an arrow YA1. In the electronic unit device 100 shown in FIG. 1, the panel body 160 is opened approximately by 90 degrees.

The cap 170 is set larger in size than the connector jack 130. The cap 170 is prepared in the cover panel 150 in a position where the cap 170 can fully cover the connector jack 130.

When to connect the electronic unit device 100 with the peripheral device 200, a user closes the cover panel 150 (the panel body 160) from which the cap 170 is taken out.

Figure 2:
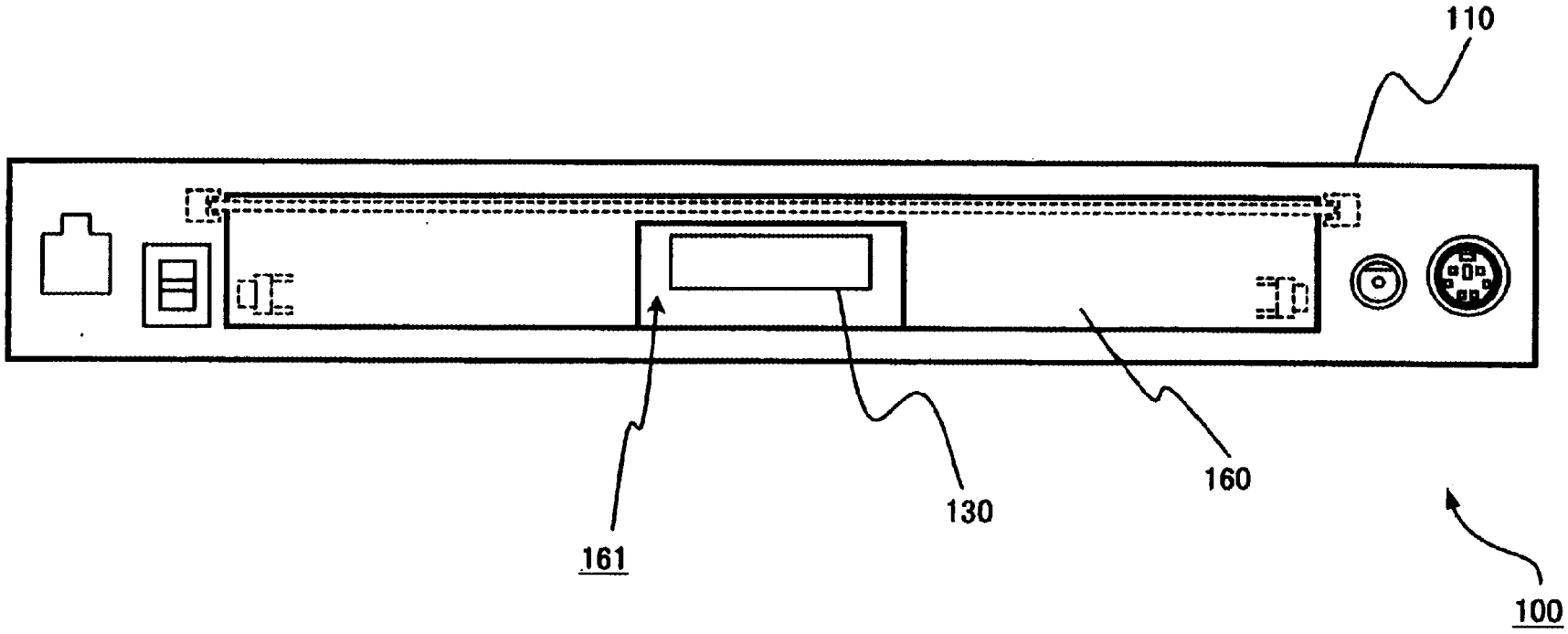
FIG. 2 is a diagram showing the back surface of the electronic unit device from which a cap is taken out and whose cover panel is closed.

FIG. 2 shows the back surface of the electronic unit device 100 whose panel body 160 is closed. As shown in FIG. 2, the surface of the connector jack 130 which is in contact with the connector plug 230 appears from a cut section 161 of the panel body 160. In this state, the user connects the connector plug 230 of the peripheral device 200 to the electronic unit device 100 in a direction from the cut section 161 to the connector jack 130.

After the user has taken out the peripheral device 200 from the electronic unit device 100, the panel body 160 is opened as shown in FIG. 1. After the cap 170 is installed in the panel 160, the cover panel 150 is closed.

Figure 3:
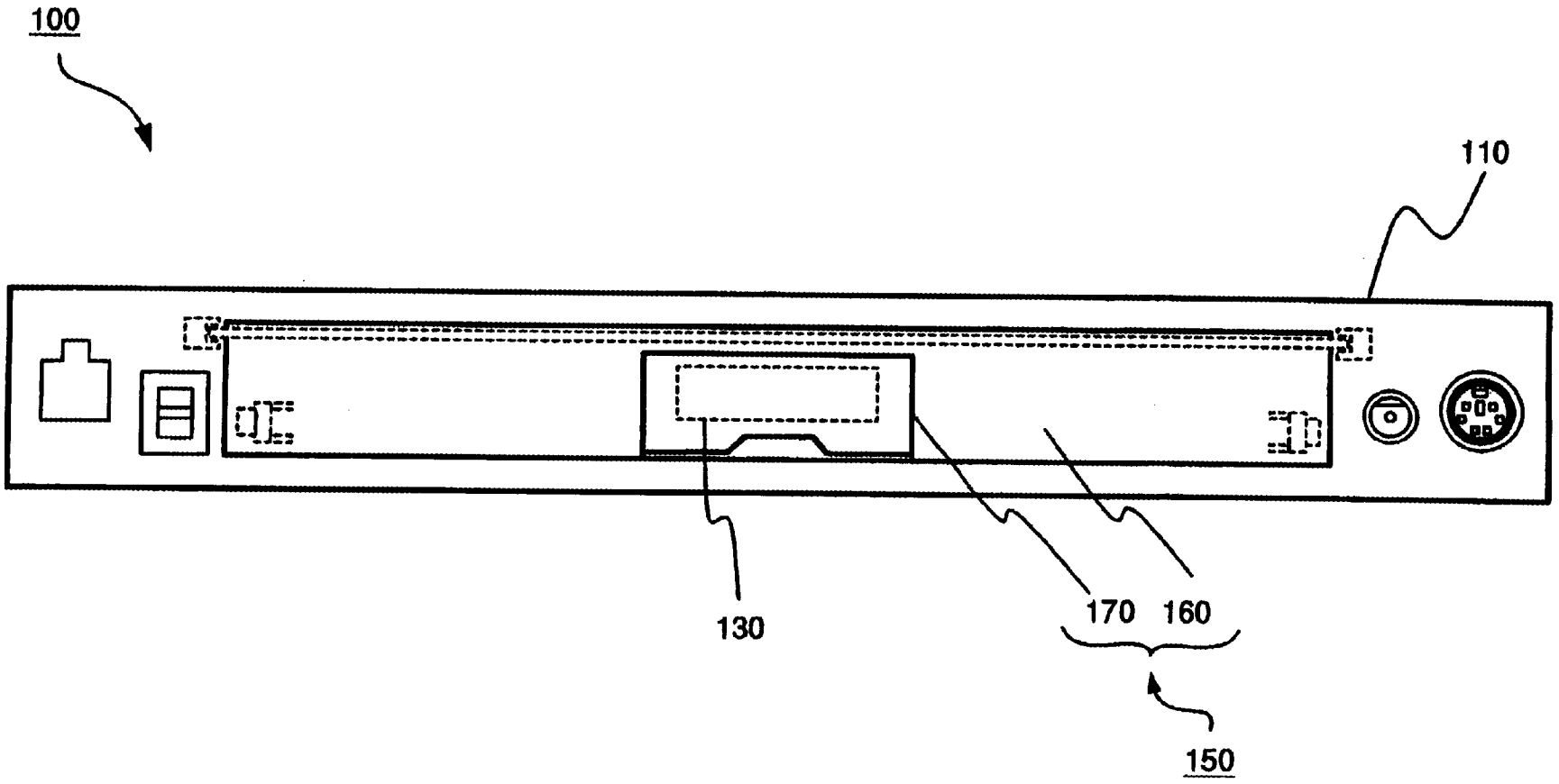
FIG. 3 is a diagram showing the back surface of the electronic unit device in which the cap is installed and whose cover panel is closed.

Shown in FIG. 3 is the back surface of the electronic unit device 100 in a state where the cap 170 is installed and the cover panel 150 is closed. As shown in the illustration, the cover panel 150 cover the connector jack 130, so as to protect the connector jack 130 from any dust entering the connector jack 130.

As explained above, the peripheral device 200 can be connected and disconnected to and from the electronic unit device 100 in the state where the panel body 160 is closed.

Explanations will now be made to the structures of the electronic unit device 100. The structures include: (0) the basic structure of the cover panel 150; (1) the guide structure for facilitating the attaching and detaching of the cap 170 to and from the panel body 160; (2) the structure for preventing the installed cap 170 from falling from the panel body 160; and (3) the structure for enabling the stable opening and closing of the cover panel 150.

(0) Basic Structure of Cover Panel 150

Figure 4:
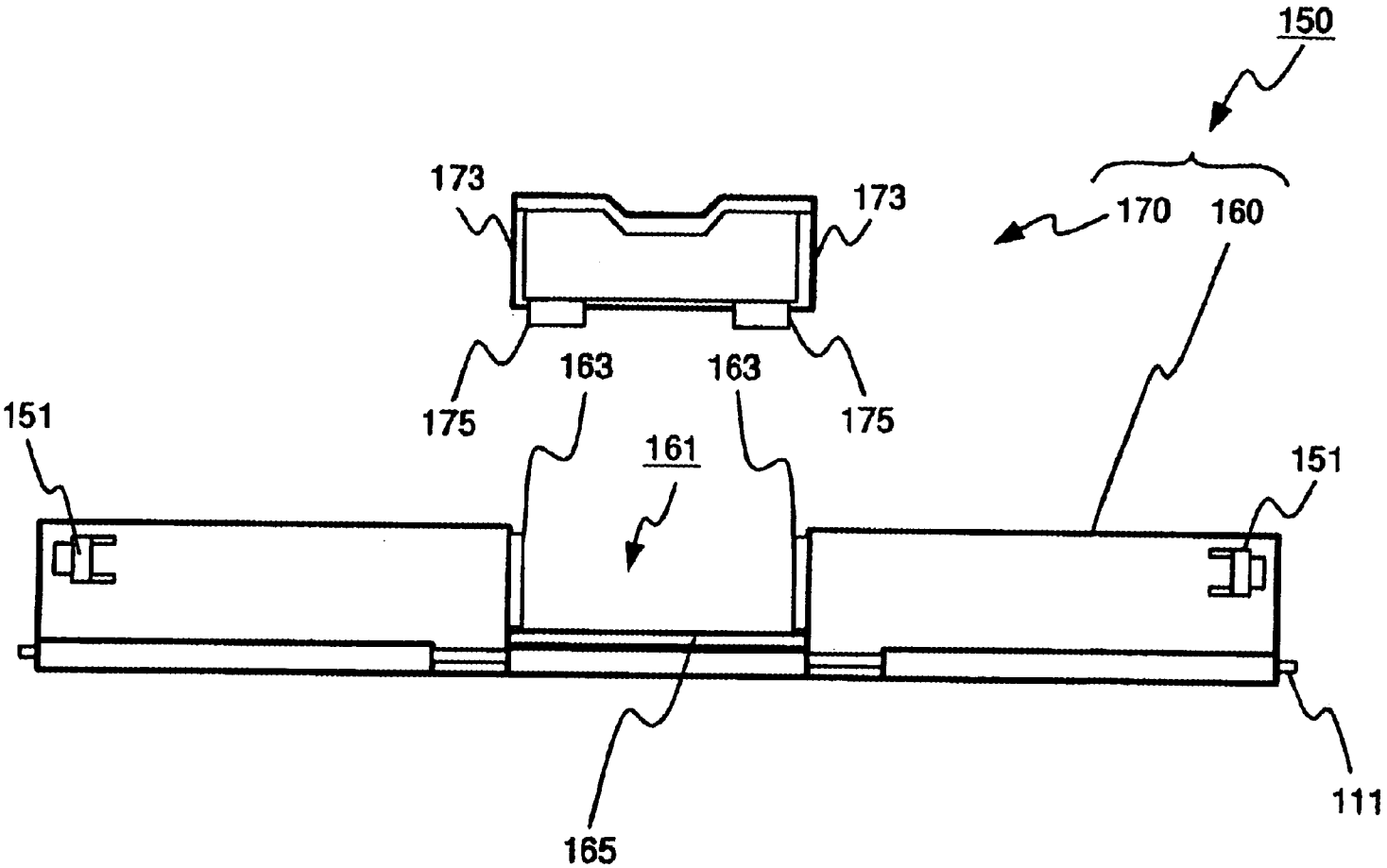
FIG. 4 is a diagram showing the back surface of the cover panel from which a cap is taken out.
Figure 5:
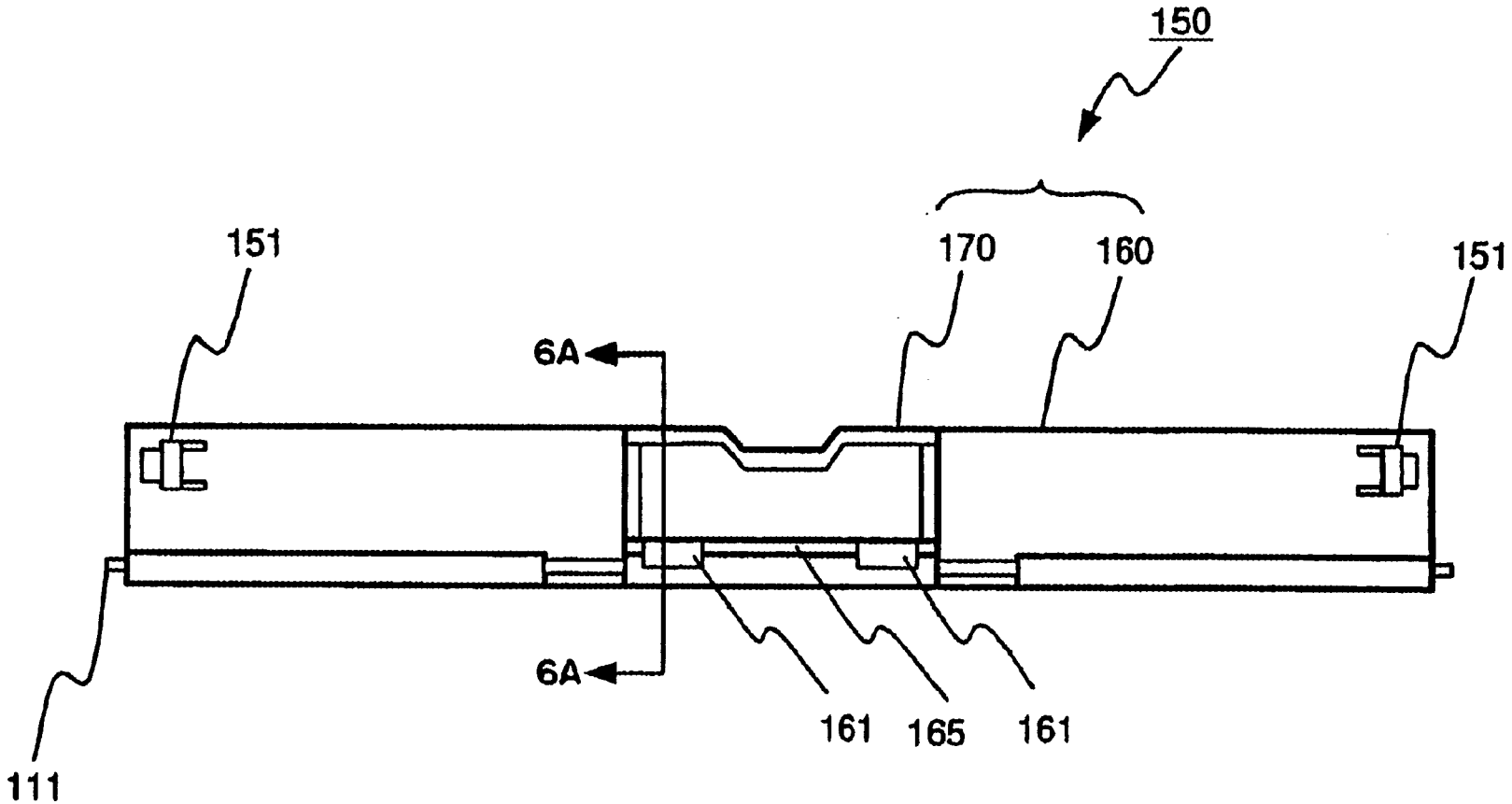
FIG. 5 is a diagram showing the back surface of the cover panel in which the cap is installed.

The cover panel 150 has the structures respectively shown in FIGS. 4 and 5. FIG. 4 shows the back surface of the cover panel 150 in a state where the panel body 160 and the cap 170 are separated from each other. FIG. 5 shows the back surface of the cover panel 150 in a state where the cap 170 is installed in the panel body 160.

As shown in FIG. 5, the cover panel 150 is a plate-shaped panel in a rectangular form having approximately the same thickness throughout the entire section thereof, in the state where the cap 170 is installed in the panel body 160.

The cover panel 150, whose back surface faces the outer surface of the casing 110, is set into the casing 110 as to cover the connector jack 130.

A spindle 111 is inserted into one side of the cover panel 150. The cover panel 150 can be attached and detached to and from the surface of the connector jack 130 about the spindle 111.

(1) Guide Structure

The cover panel 150 has the structure, as will be described below, for facilitating the attaching and detaching the cap 170 to and from the panel body 160.

As shown in FIG. 4, the panel body 160 includes two projection sections 163 on two facing edges of the cut section 161, respectively.

Each of the projection sections 163 has substantially the same section along the longitudinal direction of each edge. The length of the projection sections 163 is set equal to or shorter than the length of the edges.

As shown in FIG. 4, the cap 170 has two grooves 173 respectively corresponding to the projection sections 163 on both sides of the respective edges.

In the above-described structure, when to attach and detach the cap 170 to and from the panel body 160, the grooves 173 of the cap 170 are guided to the projection sections 163 prepared in the panel body 160. Hence, the cap 170 can be attached and detached to and from the panel body 160 with ease.

(2) Structure for Preventing Falling of Cap

The cover panel 150 has the structure for preventing the cap 170 from falling from the panel body 160.

The panel body 160 includes a cap-fixing member 165 on the back surface of the cut section 161. As shown in FIGS. 4 and 5, the cap-fixing member 165 is arranged along one side of the cut section 161 where there is no projection sections 163. The length of the cap-fixing member 165 is approximately the same as the length of the side of the cut section 161.

The cap 170 includes two cap-engagement members 175 along one side of the cut section 161 of the panel body 160, particularly on both ends of the one side where there is no groove 173. Each of the cap-engagement members 175 is made of a material such as an elastic material, rubber, etc.

Figure 6B:
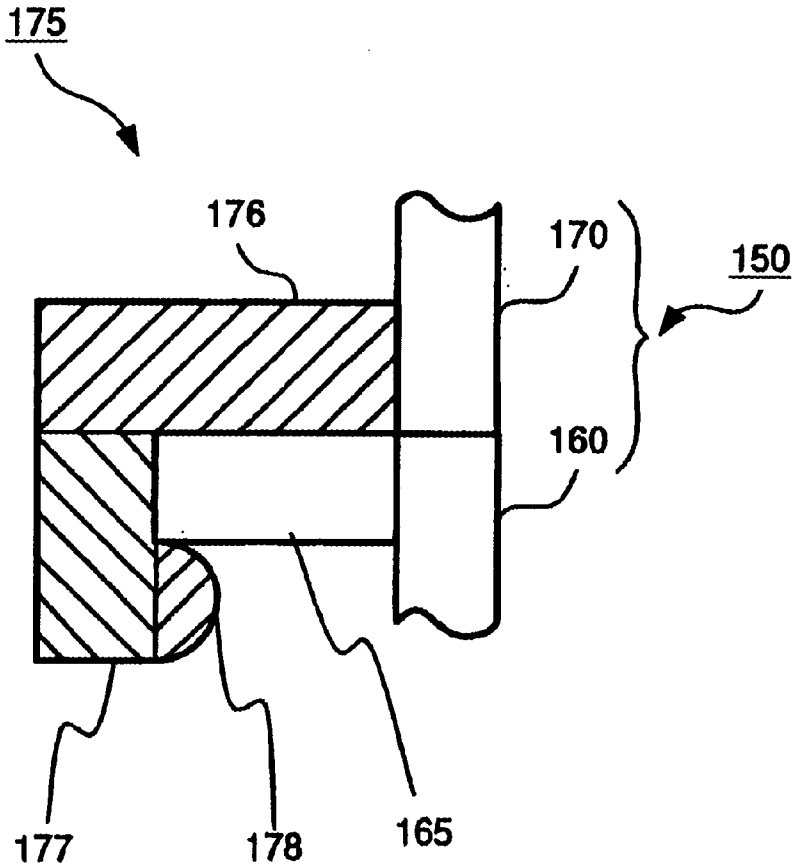
FIG. 6B is an enlarged view of apart of FIG. 6A.
Figure 6A:
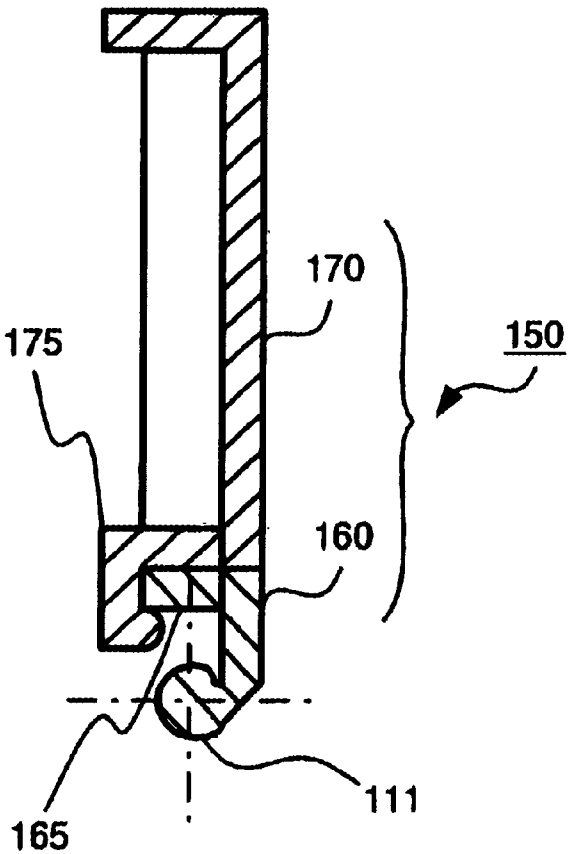
FIG. 6A is a cross-sectional view showing the cover panel, taken along a line 6A—6A shown in FIG. 5.

In the state where the cap 170 is installed in the panel body 160, the cap-engagement members 175 are engaged with the cap-fixing member 165. FIG. 6A is a cross-sectional view showing the cover panel 150 taken along a line 6A—6A shown in FIG. 5 and view from a direction of the arrow in FIG. 5. FIG. 6B is an enlarged section of the cap-engagement member 175 shown in FIG. 6A.

As shown in FIG. 6B, each of the cap-engagement member 175 has the structure which can be divided into three parts, i.e. the first piece 176, the second piece 177, and a swollen section 178. The first piece 176 generally stands on the back surface of the cap 170. The second piece 177 is prepared approximately perpendicular to the first piece 176 in a direction toward the panel body 160. The swollen section 178 is swollen in a direction from the second piece 177 to the panel body 160, and has an end in the form of a sphere-like shape.

The first piece 176, second piece 177 and the swollen section 178 respectively have such sizes that the cap-engagement members 175 are engaged with the cap-fixing member 165.

In the state where the cap 170 is installed in the panel body 160, the cap-fixing member 165 is engaged with the two cap-engagement members 175. In this structure, the cap 170 is prevented from dropping from the panel body 160. The cap-engagement members 175 are made of an elastic material, so as to be extensible at that time of attaching and detaching the cap 170 to and from the panel body 160. Hence, the cap-engagement members 175 prevent the falling of the cap 170, and facilitates the detaching of the cap 170.

(3) Structure for Enabling Stable Opening and Closing of Cover Panel 150

Figure 7:
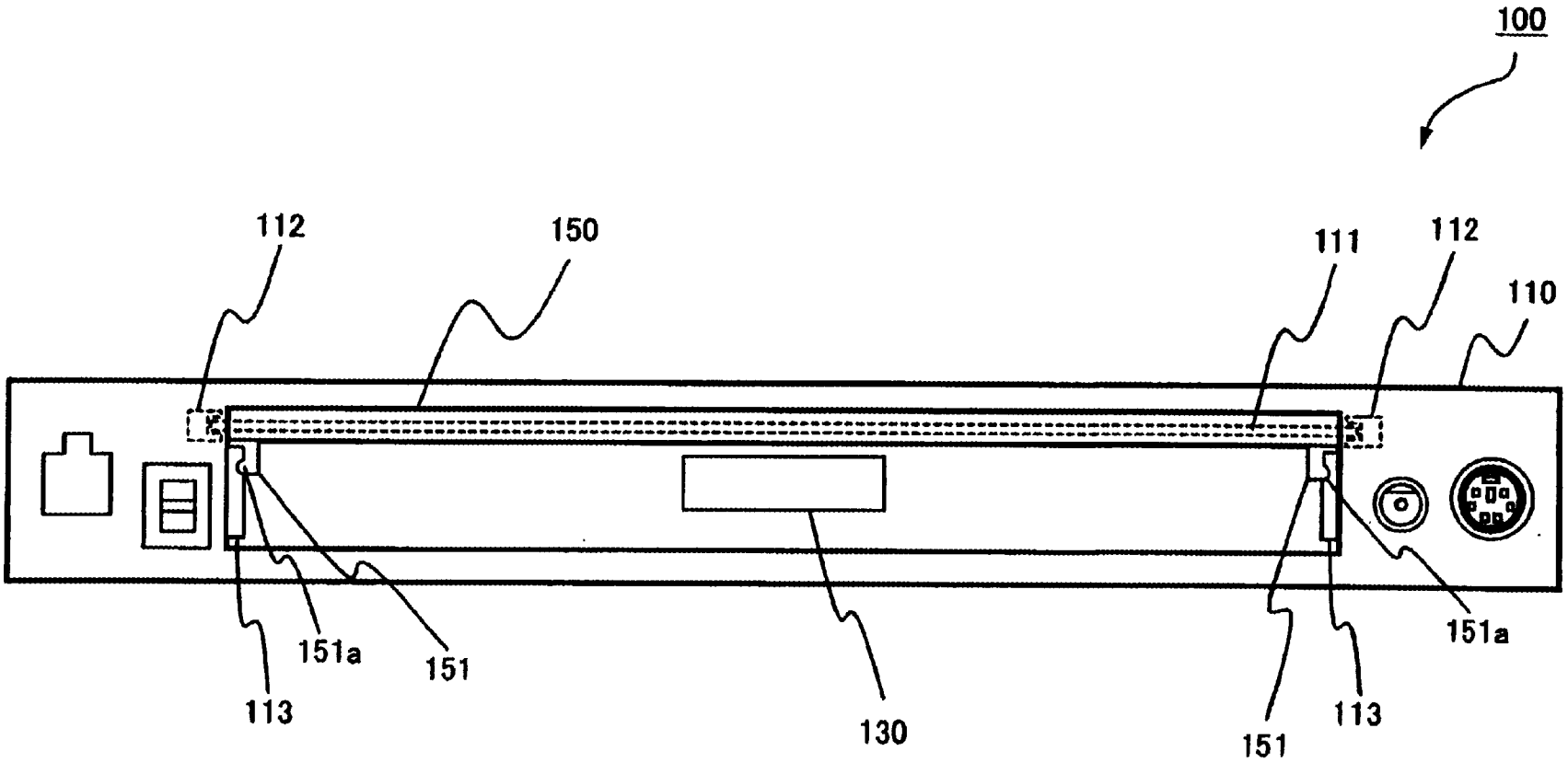
FIG. 7 is a diagram showing the back surface of the electronic unit device in which the cap is installed and whose cover panel is opened.

As illustrated in FIG. 7, the electronic unit device 100 has the structure for enabling the stable opening and closing of the cover panel 150. FIG. 7 is a diagram showing the back surface of the electronic unit device 100 in the state where the cover panel 150 is opened approximately by 90 degrees.

As shown in the illustration, the casing 110 includes two spindle holders 112 and two cover-panel-fixing members 113. Each of the spindle holders 112 holds the spindle 111 after inserted into the cover panel 150. Each of the cover-panel-fixing members 113 is a plate-shaped material, and fixes the cover panel 150 in the state where the cover panel 150 is closed.

The cover panel 150 includes two cover-panel-engagement members 151 for engaging the cover panel 150 with the casing 110 at both ends of a side facing the spindle 111.

Each of the cover-panel-engagement members 151 is made of an elastic material, such as rubber, or the like. Each of the cover-panel-engagement members 151 has an swollen section 151*a*. The swollen section 151*a* has an end which is processed so as to have a spherical shape.

Figure 8:
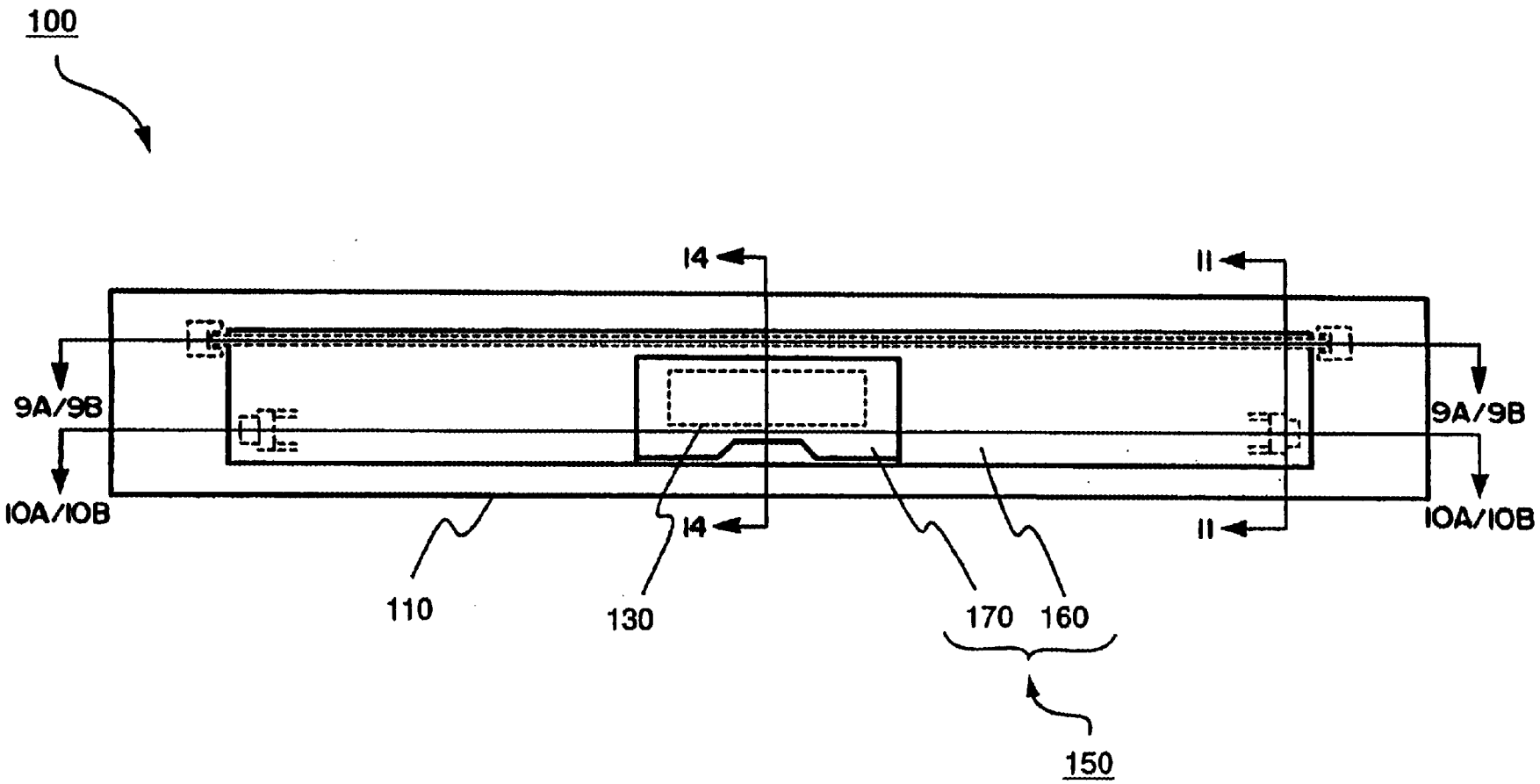
FIG. 8 is a diagram showing the back surface of the electronic unit device in which the cap is installed and whose cover panel is closed.
Figure 9B:
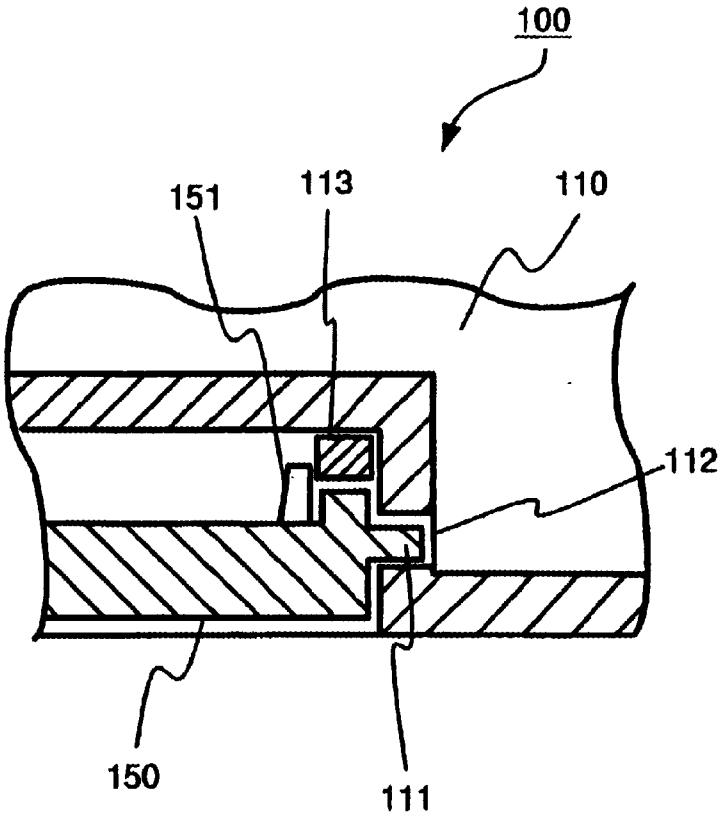
FIG. 9B is a cross sectional view showing an end section of the cover panel which includes the other end thereof, taken along the line 9A/9B—9A/9B of FIG. 8.
Figure 9A:
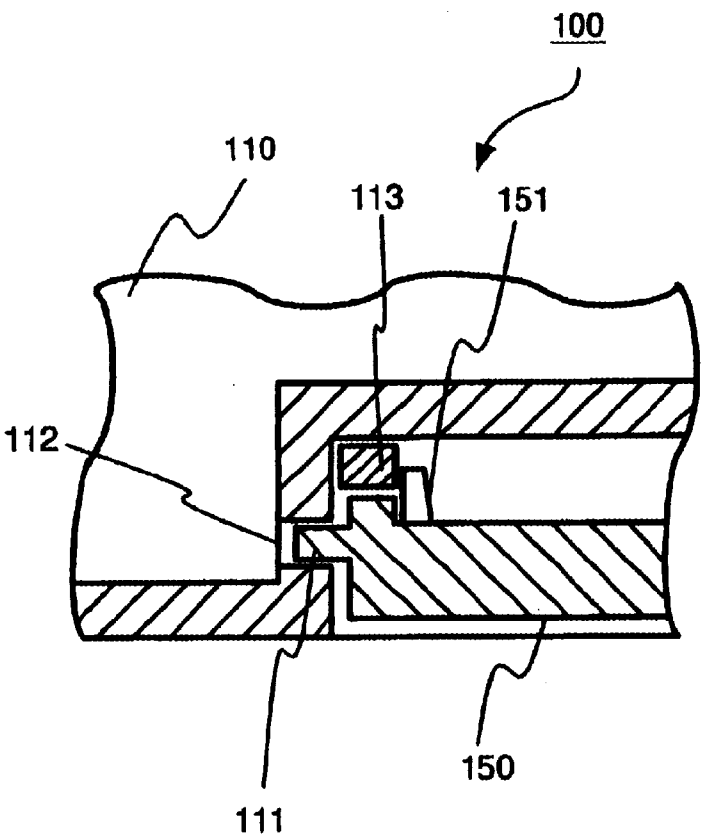
FIG. 9A is a cross sectional view showing an end section of the cover panel which includes one end thereof, taken along a line 9A/9B—9A/9B of FIG. 8.
Figure 10B:
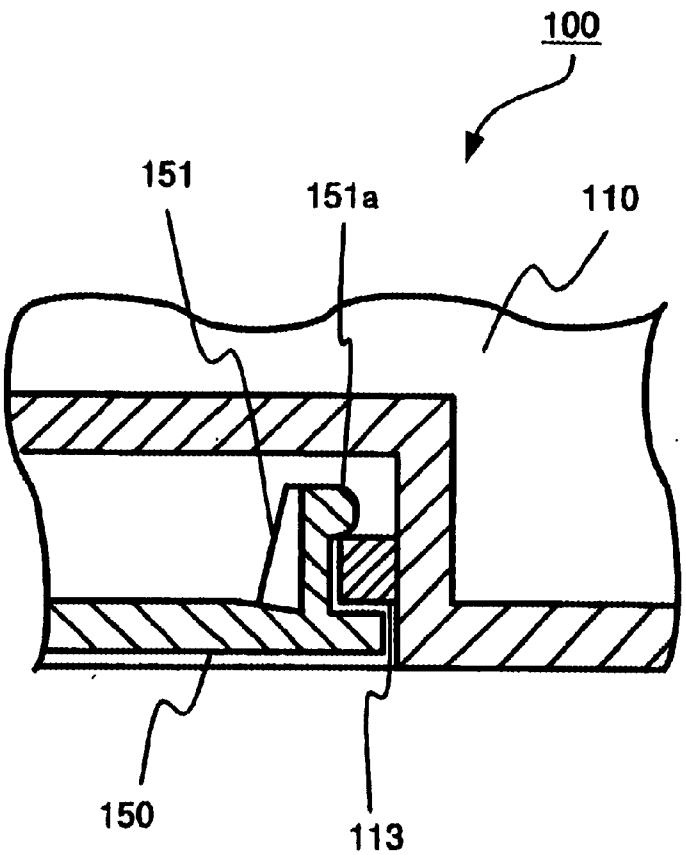
FIG. 10B is a cross sectional view showing an end section of the cover panel which includes the other end thereof, taken along a line 10A/10OB—10A/10B of FIG. 8.
Figure 10A:
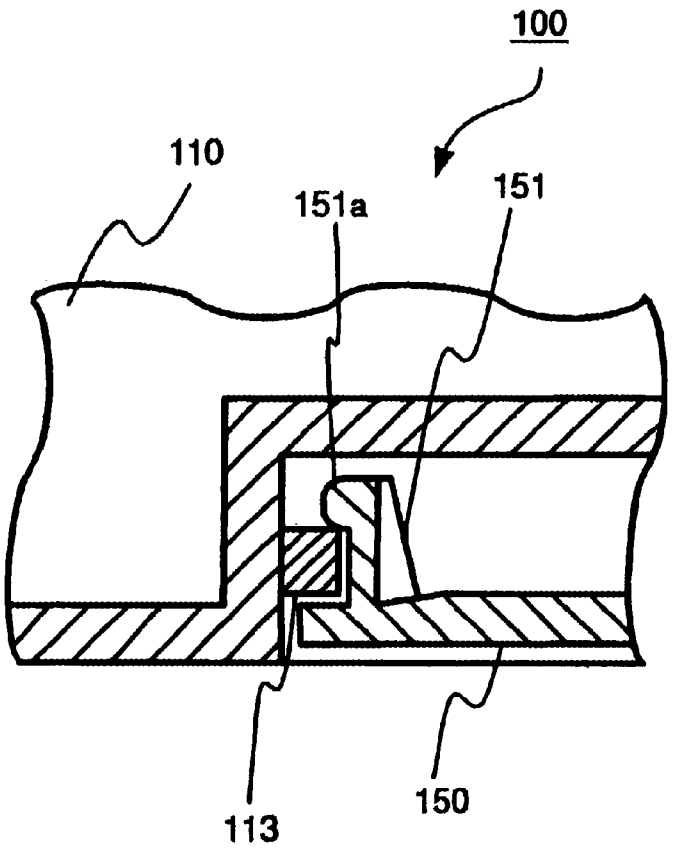
FIG. 10A is a cross sectional view showing an end section of the cover panel which includes the one end thereof, taken along a line 10A/10B—10A/10B of FIG. 8.
Figure 11:
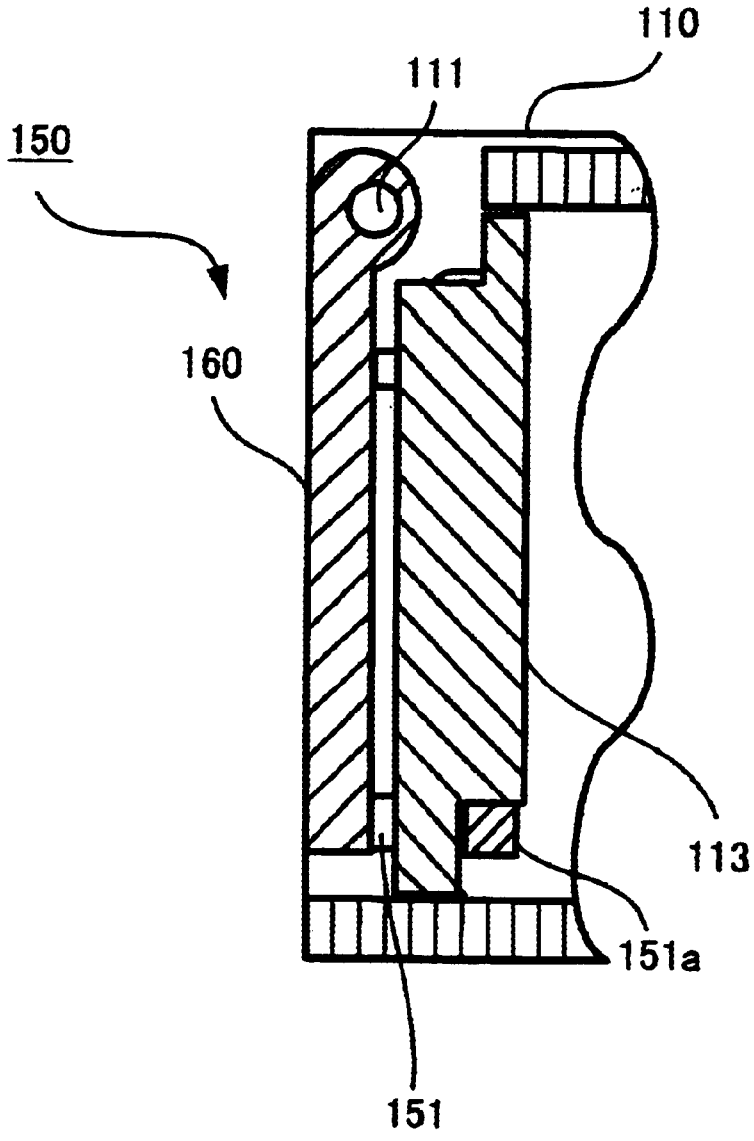
FIG. 11 is a cross sectional view showing the electronic unit device taken along a line 11—11 of FIG. 8.

The cover-panel engagement members 151 are engaged with the cover-panel fixing members 113, respectively, in a manner as will be explained below. FIG. 8 shows the electronic unit device 100 in the state where the cover panel 150 of FIG. 7 is closed. FIGS. 9 to 11 show cross sectional views each showing the electronic unit device 100 of FIG. 8 (illustrating the electronic unit device 100 of FIG. 3 with attached lines for explanatory purposes). FIGS. 9A and 9B are cross sectional views each showing the electronic unit device 100 taken along a line 9A/9B—9A/9B shown in FIG. 8, and respectively show end sections of the cover panel 150, when viewed in a direction of the line 9A19B—9A19B in FIG. 8. Similarly, FIGS. 10A and 10B are cross sectional views each showing the electronic device 100 taken along line 10A/10B—10A/10B shown in FIG. 8, and respectively show end sections of the cover panel 150, when viewed in a direction of arrow of the line 10A/10B—10A/10B of FIG. 8. Further, FIG. 11 is a cross sectional view showing the electronic unit device 100 taken along a line 11–11' of FIG. 8, when viewed in a direction of an arrow of the line 11–11' shown in FIG. 8

As seen from FIGS. 9 to 11, the cover-panel-engagement members 151 are arranged respectively in position corresponding to the cover-panel fixing members 113. The size of the cover-panel engagement members 151 is so set that the cover-panel engagement members 151 are fixed to the respective cover-panel fixing members 113.

According to the above-described structure, the cover-panel engagement members 151 have the function for efficiently engaging the cover panel 150 with the casing 110, even when the cap 170 is detached from the cover panel 150. Because the cover-panel engagement members 151 are formed of an elastic material, they are extensible at the time of closing and opening the cover panel 150. Hence, the cover-panel engagement members 151 can attach and detach the cover panel 150 to and from the casing 110 with ease.

Explanations will now specifically be made to a method for attaching and detaching the cap 170 to and from the panel body 160 of the cover panel 150. When to connect the peripheral device 200 to the electronic unit device 100, the peripheral device 200 can be connected thereto, in the state where the cover panel 150 is simply opened, likewise in the conventional technique.

Figure 12:
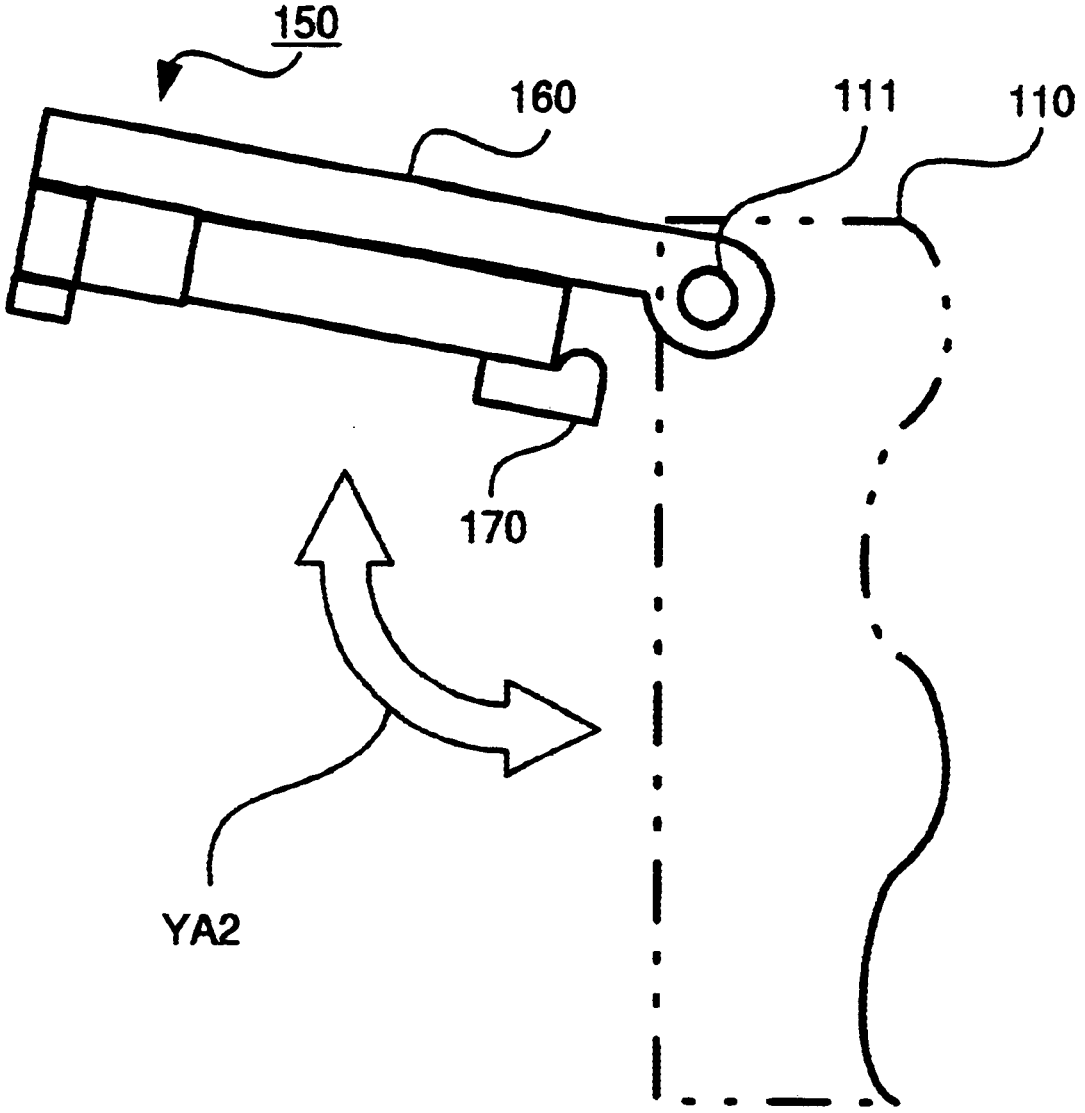
FIG. 12 is a cross sectional view showing the electronic unit device wherein the cap is installed in the panel body and whose cover panel is opened.

According to the method of the present invention, the peripheral device 200 can be connected to the connector jack 130 of the electronic unit device 100, when the cover panel 150 is a more stable state than the state of the cover panel 150 according to the conventional technique. A user moves the cover panel 150 in a direction shown with an arrow YA2, so as to open the cover panel 150, as shown in FIG. 12.

Even if the cover panel 150 is opened slightly at an acute angle, the cap 170 can be taken out from the cover panel 150. In this case, the cover panel 150 is to open upward. However, even if the cover panel 150 is to be closed downward, the cap 170 can be detached from the cover panel 150.

Figure 13:
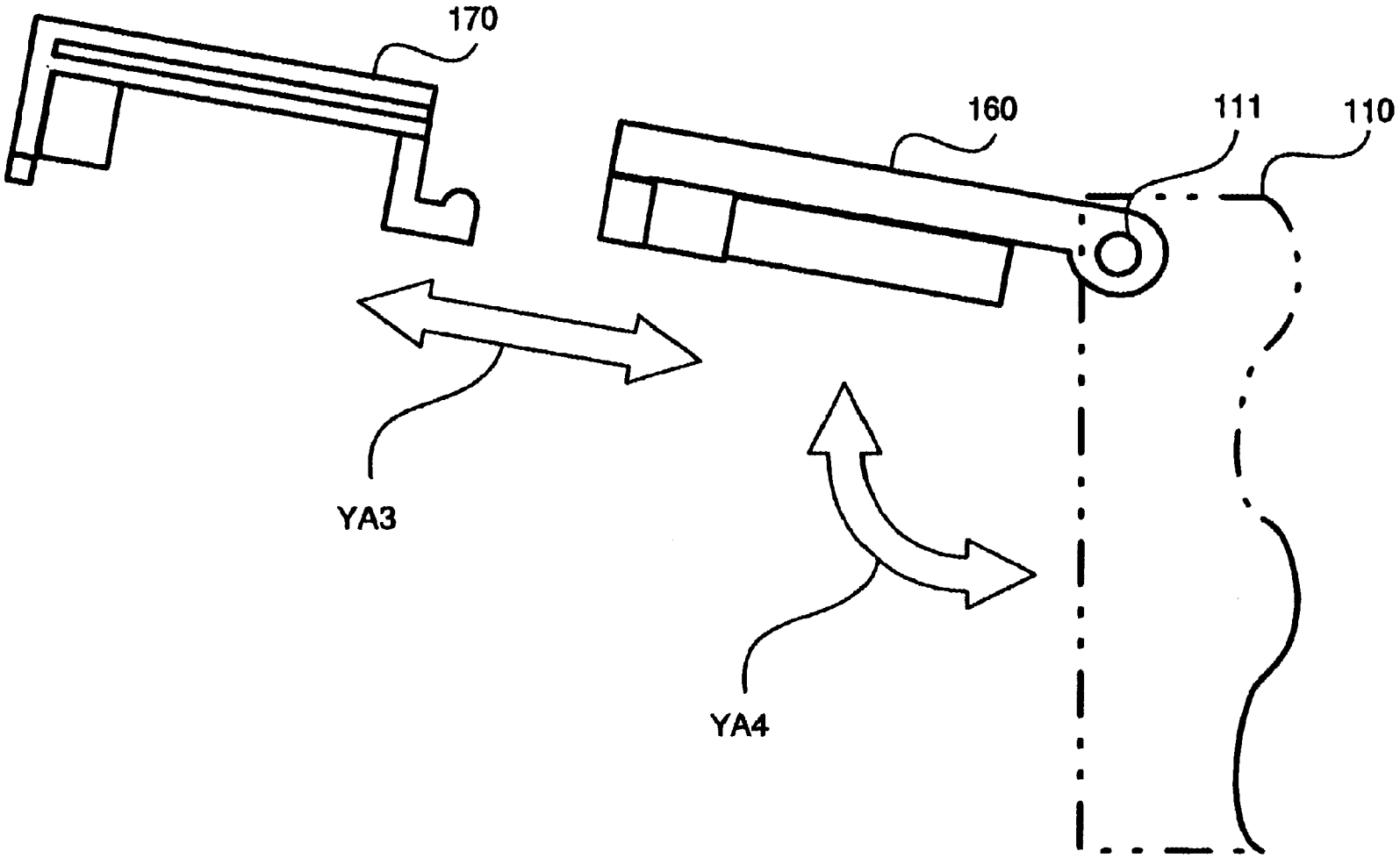
FIG. 13 is a cross sectional view showing the electronic unit device wherein the cap is detached from the panel body and whose cover panel is opened.

The cap 170 is detached from the panel body 160 generally in a horizontal direction shown with an arrow YA3 shown in FIG. 13. After this, the panel body 160 is moved in a direction shown with an arrow YA4 so as to be closed, as shown in FIG. 13. When the cap 170 is detached from the electronic unit device 100 and the cover panel 150 is closed, the back surface of the electronic unit device 100 is in the state shown in FIG. 2.

After the cap 170 is taken out from the electronic unit device 100, the user simply needs to install the connector plug 230 of the peripheral device 200 in the connector jack 130 which appears from the space of the cut section 161 of the panel body 160, approximately in a vertical direction. At this time, the cover panel 150 is in such a state where the cut section 161 is visible to the user. The swollen section 151*a* of each of the cover-panel engagement members 151 arranged on the back surface (invisible to the user) of the cover panel 150 is engaged with the cover-panel fixing member 113 arranged on the casing 110. In this structure, the cover panel 150 is stably fixed in the casing 110.

Figure 14:
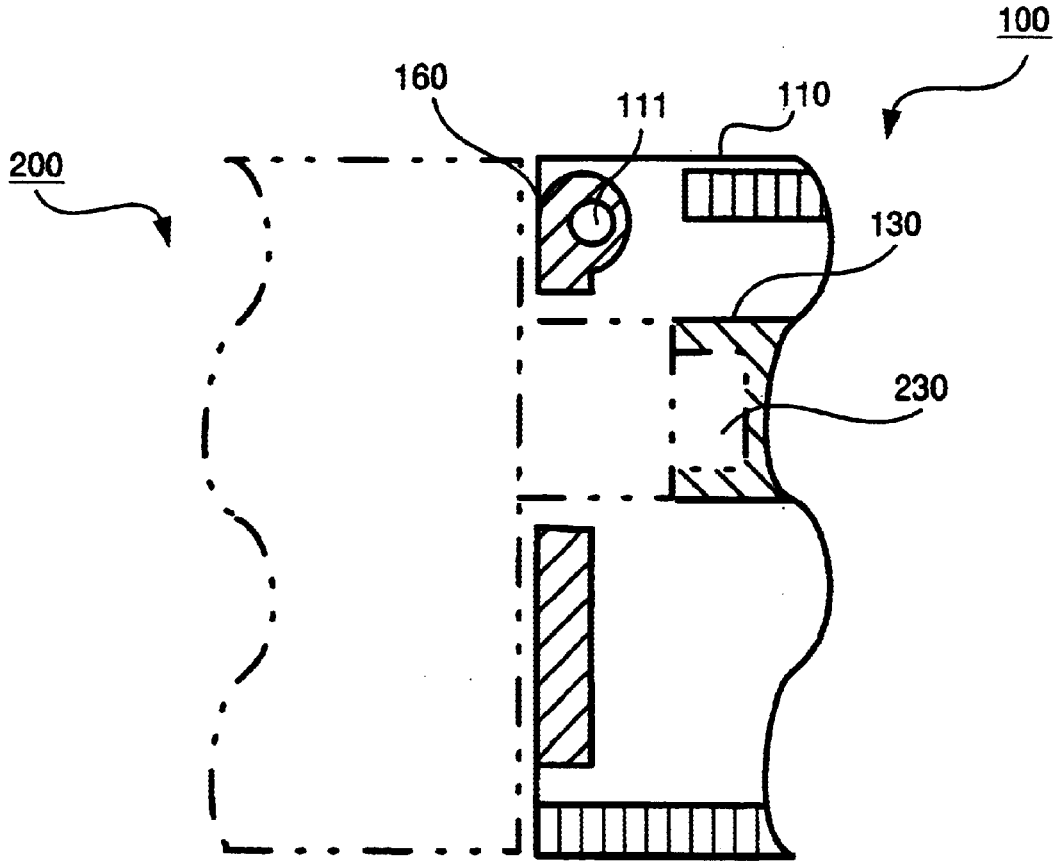
FIG. 14 is a cross-sectional view showing the electronic unit device to which the peripheral device is connected, taken along a line 14—14 of FIG. 8.

Hence, the user needs not press the cover panel 150 by hand, and the user holds the peripheral device 200 in his/her hand, and installs the connector plug 230 in the connector jack 130. FIG. 14 shows the electronic unit device 100 in which the peripheral unit device 200 is thus installed. FIG. 14 is a cross sectional view showing the electronic unit device 100, to which the peripheral device 200 is connected, taken along a line 14—14 shown in FIG. 8, when viewed in a direction of an arrow of the line 14—14. As shown in FIG. 14, the panel body 160 from which the cap 170 is detached is closed. The connector plug 230 of the peripheral device 200 is inserted into the connector jack 130 of the electronic unit device through the cut section 261.

When to take out the peripheral device 200 from the electronic unit device 100, there is no need to hold the cover panel 150 by hand. Thus, the peripheral device 200 can be detached from the electronic unit device 100 of this embodiment, by both hands. After the peripheral device 200 is detached from the electronic unit device 100, the user installs the cap 170 in the panel body 160. The installation of the cap 170 in the panel body 160 can be achieved by processing the detaching procedures in the reverse order.

As described above, according to this embodiment, it is preventable that the electronic unit device 100 is in contact with the peripheral device 200 when the cover panel 150 is opened and in an unstable state. Hence, the cover panel 150 is prevented from being damaged and falling off from the panel body 160.

Since the projection sections 163 are prepared on the cut section 161 of the panel body 160, and the grooves 173 are prepared respectively in positions corresponding to the projection sections 163, the cap 170 is guided to the panel body 160 by the projection sections 163 so as to be installed in the panel body 160. This facilitates the installation of the cap 170 in the panel body 160. Similarly, when to detach the cap 170 from the panel body 160, the cap 170 is guided by the projection sections 163, thus facilitating the detaching of the cap 170 therefrom.

In this embodiment, only one cap 170 is included in the cover panel 150 so as to correspond to the single connector jack 130. However, the number of the cap 170 is not limited to one, and two or more caps 170 can be included in the cover panel 150 so as to correspond respectively to two or more connector jacks 130. In this case, a plurality of cut sections 161 should be prepared in the panel body 160 in such a manner that each of the plurality of cut sections 161 corresponds to each of the caps 170 and each of the connector jacks 130.

In this embodiment, the projection sections 163 are prepared on the panel body 160, and the grooves 173 corresponding to the projection sections 163 are prepared in the cap 170. However, the electronic unit device can have the structure in which the grooves are prepared in the panel body 160, and the projection sections corresponding to the grooves are prepared on the cap 170, instead.

In this embodiment, one cap-fixing member 165 is prepared in the cut section 161 of the panel body 160 so as to prevent the cap 170 from falling from the panel body 160. However, the number of the cap-fixing member 165 is not limited to one. For example, the length of the cap-fixing member 165 can be set to coincide with the width of the cap-engagement member 175, and two or more cap engagement members can be prepared in positions corresponding to positions of the cap-engagement members 175.

In this embodiment, two cap-engagement members 175 are included in the cap 170. However, the number of the cap-engagement members 175 is not limited to two, and an arbitrary number of cap-engagement members 175 can be prepared.

In this embodiment, the explanations have been made to the cover panel of the electronic unit device, as one to be arranged on the back surface of the casing and to be moved upward. However, the cover panel can be arranged on the front surface, side surface, top or bottom surface of the casing. For example, the spindle of the cover panel is prepared in a lower or side section of the cover panel, so that the cover panel is opened in an upward direction or in a direction from right to left.

In this embodiment, the cover panel 150, the cut section 161 of the panel body 160, and the cap 170 have been described as to have a rectangular shape. The shape of the above sections is not limited to a rectangular shape, and can be other shapes including, any other polygonal shapes, circular shapes, for example.

In this embodiment, the explanations have been made to the electronic unit device as a portable personal computer. However, the electronic unit device may be any other general-purpose electronic unit device, such as a desktop personal computer, a server computer, a mobile data processing device, etc.

In this embodiment, the peripheral device has been described as a port bar. However, the peripheral device may be any other type of electronic unit device, such as a printer, a scanner, a digital camera, etc.

Various embodiments and changes may be made thereonto without departing from the broad spirit and scope of the invention. In the above-described embodiment, the cover panel of the electronic unit device has been described as one which can be opened and closed. However, the cover panel may be fixed to be closed. In such a case, a hook holder for holding a hook of the cap is prepared, and a hook is arranged on one side of the cap, and further a pull is arranged on the other side of the cap. When the user takes out the cap, the pull is pulled out pivotably about the hook, so that the cap is no longer engaged with the panel body. When the user installs the cap in the panel body, the user engages the hook of the cap with the hook holder, and presses the pull toward the cover panel approximately in a vertical direction. The attaching and detaching of the cap is arbitrarily performed, and any other methods can be applicable.

The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2000-133224 filed on May 2, 2000, and including specification, claims, drawings and summary. The disclosure of the above Japanese Patent Application is incorporated herein by reference in its entirety.

What is claimed is:

1. An electronic unit device comprising:

a connector which is connectable to a to-be-connected device; and a panel body, which can be opened and closed, the panel body having a cut section, and a partial panel which is attachable and detachable by sliding in and out in the same plane as the panel body to and from the cut section, the partial panel covering at least said connector when the partial panel is attached to the cut section, at least one of the cut section and the partial panel facing the connector when the panel body is closed.

2. An electronic unit device comprising:

a casing which contains an electronic device;

a connector which is included inside said casing and connectable to a to-be-connected device; and a cover panel which can be opened and closed, the cover panel including a panel body, the panel body having a cut section, and a partial panel which is attachable and detachable by sliding in and out in the same plane as the panel body to and from the cut section, the partial panel filling the cut section when the partial panel is attached to the cut section, the partial panel covering at least a surface of said connector, at least one of the cut section and the partial panel facing the connector when the cover panel is closed.

3. The electronic unit device according to claim 2, wherein the partial panel includes one side facing the cut section, the panel body connected to an outer wall of said casing, the partial panel being opened and closed pivotably about the one side facing the cut section.

4. The electronic unit device according to claim 2, wherein said partial panel has a shape which corresponds to a shape of the cut section.

5. An electronic unit device comprising:

a casing which contains an electronic device;

a connector which is included inside said casing and connectable to a to-be-connected device; and a cover panel which can be opened and closed, the cover panel including a panel body, the panel body having a cut section, and a partial panel cap which is attachable and detachable to and from the cut section, the partial panel cap filling the cut section when the partial panel cap is attached to the cut section, the partial panel cap covering at least a surface of said connector, said panel body including a falling-prevention section for preventing said partial panel cap from falling from the cut section, said falling-prevention section such that said panel body includes a cap-fixing member on the back surface of the cut section, the cap-fixing member being arranged along one side of the cut section having no projection sections, the partial panel cap including at least one cap-engagement member along the one side having no projection members of the cut section of the panel body, so that when the partial panel cap is installed in the panel body, the cap-fixing member is engaged with the at least one cap-engagement members preventing the partial panel cap from falling from the panel body.

6. The electronic unit device according to claim 2, wherein said panel body includes a guide section which can guide the partial panel.

7. The electronic unit device according to claim 5, wherein the partial panel includes at least one engagement section which can be engaged with said fallingprevention section.

8. The electronic unit device according to claim 6, wherein the partial panel includes a section, which contacts the panel body and is so processed as to be engaged with the guide section.

9. The electronic unit device according to claim 6, wherein:

said panel body includes the cut section which is formed in a rectangular shape; and said guide section includes a projection section or groove having substantially a same section throughout a longitudinal direction of each of facing sides of the cut section.

10. The electronic unit device according to claim 9, wherein said partial panel is formed substantially in a rectangular shape, and includes a projection section or groove having substantially a same section throughout a longitudinal direction thereof, along an edge corresponding to the guide section of the panel body.

11. The electronic unit device according to claim 7, wherein said engagement section is formed of an elastic material.

12. An electronic unit device comprising:

a connector which is connectable to a to-be-connected device; and a casing having a panel body which can be opened and closed, the panel body including a cut section, and a partial panel cap which is attachable and detachable to and from the cut section, said partial panel cap covering at least said connector when the partial panel cap is attached to the cut section, said panel body including a falling-prevention section for preventing said partial panel cap from falling from the cut section, said falling-prevention section such that said panel body includes a cap-fixing member on the back surface of the cut section, the cap-fixing member being arranged along one side of the cut section having no projection sections, the partial panel cap including at least one cap-engagement member along the one side having no projection members of the cut section of the panel body, so that when the partial panel cap is installed in the panel body, the cap-fixing member is engaged with the at least one cap-engagement members preventing the partial panel cap from falling from the panel body.

13. The electronic unit device according to claim 2, wherein the panel body can be opened and closed pivotably about one side thereof.

14. The electronic unit device according to claim 5, wherein the panel body includes one side facing the cut section and being connected to an outer wall of said casing, and can be opened and closed pivotably about the one side facing the cut section.

15. The electronic unit device according to claim 5, wherein said partial panel cap has a shape which corresponds to a shape of the cut section.

16. The electronic unit device according to claim 5, wherein said panel body includes a guide section which can guide the partial panel cap.

17. The electronic unit device according to claim 5, wherein the panel body can be opened and closed pivotably about one side thereof.

* * * * *